US011414242B2

(12) United States Patent
Wada et al.

(10) Patent No.: US 11,414,242 B2
(45) Date of Patent: Aug. 16, 2022

(54) SPOUT ASSEMBLY AND PACKAGING CONTAINER HAVING THE SPOUT ASSEMBLY

(71) Applicant: TOPPAN PRINTING CO., LTD., Tokyo (JP)

(72) Inventors: Kiyoshi Wada, Tokyo (JP); Yusuke Nakano, Tokyo (JP); Satoshi Yamade, Tokyo (JP); Akihiko Komiyama, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 243 days.

(21) Appl. No.: 16/782,917

(22) Filed: Feb. 5, 2020

(65) Prior Publication Data

US 2020/0172298 A1 Jun. 4, 2020

Related U.S. Application Data

(63) Continuation of application No. PCT/JP2018/030110, filed on Aug. 10, 2018.

(30) Foreign Application Priority Data

Aug. 10, 2017 (JP) ..... JP2017-155976
Jul. 26, 2018 (JP) ..... JP2018-140154
(Continued)

(51) Int. Cl.
*B65D 41/04* (2006.01)
*B65D 5/74* (2006.01)

(52) U.S. Cl.
CPC ..... *B65D 41/0414* (2013.01); *B65D 5/74* (2013.01)

(58) Field of Classification Search
CPC ..... B65D 41/0414; B65D 41/0421; B65D 41/0471; B65D 41/0407; B65D 41/04;
(Continued)

(56) References Cited

U.S. PATENT DOCUMENTS 3,189,072 A * 6/1965 Starr ..... B65D 41/0414 215/321
4,301,937 A * 11/1981 Von Hagel ..... B65D 41/3404 215/252
(Continued)

FOREIGN PATENT DOCUMENTS

FR 1479330 A 5/1967
FR 2327930 A1 5/1977
(Continued)

OTHER PUBLICATIONS

Chinese Office Action received in CN Application No. 201880051859.1 dated Apr. 23, 2021 (13 pages).
(Continued)

*Primary Examiner* — J. Gregory Pickett
*Assistant Examiner* — Abigail Elizabeth Guidry
(74) *Attorney, Agent, or Firm* — Foley & Lardner LLP

(57) ABSTRACT

A spout assembly includes a spout and a cap. The cap includes an inner ring having an outer peripheral surface provided with a first region with a first outer diameter and a second region with a second outer diameter. The spout includes a side wall having an inner peripheral surface provided with a first region having a first inner diameter and a second region having a second inner diameter. When the cap is threadably engaged with the spout, the first region of the inner ring is in close contact with the first region of the side wall of the spout throughout the circumference, and the
(Continued)

second region of the inner ring is in close contact with the second region of the side wall of the spout throughout the circumference.

20 Claims, 10 Drawing Sheets

(30) Foreign Application Priority Data

Aug. 3, 2018 (JP) ..... JP2018-146726
Aug. 7, 2018 (JP) ..... JP2018-148819

(58) Field of Classification Search
CPC .... B65D 41/185; B65D 41/3447; B65D 5/74; B65D 5/746; B65D 5/64; B65D 5/54
See application file for complete search history.

(56) References Cited

U.S. PATENT DOCUMENTS 4,526,282 A * 7/1985 Dutt ..... B29C 45/4407 215/252
4,712,699 A * 12/1987 Lutz ..... B65D 41/0414 215/307
5,176,300 A * 1/1993 Kishikawa ..... B29C 65/08 220/265
5,275,287 A 1/1994 Thompson
6,041,953 A * 3/2000 Goodall ..... B65D 41/0414 215/354
6,382,444 B1 * 5/2002 Nyman ..... B65D 41/0471 215/218
6,581,792 B1 6/2003 Limanjaya
7,878,351 B2 * 2/2011 Falzoni ..... B65D 41/3428 215/252
7,878,353 B2 * 2/2011 Casale ..... B65D 5/749 215/297
8,281,945 B2 * 10/2012 Roussy ..... B65D 1/0246 215/333
2001/0045406 A1 * 11/2001 Zumbunl ..... B65D 41/3428 215/252
2003/0062330 A1 * 4/2003 Scalese ..... B01L 3/50825 215/354
2008/0169262 A1 * 7/2008 Ekkert ..... B65D 41/0414 215/250
2013/0186899 A1 * 7/2013 Barron ..... B65D 51/226 220/288
2013/0200036 A1 * 8/2013 Delage ..... B65D 41/0421 215/344
2017/0225851 A1 * 8/2017 Wada ..... B65D 47/123
2018/0002062 A1 * 1/2018 Morimoto ..... B65D 5/40
2018/0009579 A1 1/2018 Wada et al.
2020/0172298 A1 * 6/2020 Wada ..... B65D 41/325
2020/0331663 A1 * 10/2020 Edie ..... B65D 41/3423
2021/0309420 A1 * 10/2021 Druitt ..... B65D 41/3428

FOREIGN PATENT DOCUMENTS

GB 2 264 108 A 8/1993
GB 2264108 A * 8/1993 ..... B65D 50/041
JP 11105904 A * 4/1999 ..... B65D 41/3428
JP 2003063550 A * 3/2003
JP 2004051126 A * 2/2004
JP 2004067101 A * 3/2004
JP 2004189272 A * 7/2004
JP 2004315017 A * 11/2004
JP 2004359325 A * 12/2004
JP 2006-021782 A 1/2006
JP 2006290399 A * 10/2006
JP 2008132642 A * 6/2008
JP 2011105381 A * 6/2011
JP 2012136238 A * 7/2012
JP 2013151310 A * 8/2013
JP 2015071430 A * 4/2015
JP 2016-011128 A 1/2016
JP 2016-182983 A 10/2016
JP 2017-114546 A 6/2017
JP 2020023342 A * 2/2020
JP 2020114741 A * 7/2020
JP 2021037983 A * 3/2021
KR 10-2009-0041946 A 4/2009
WO WO-00/34133 6/2000
WO WO-2012020637 A1 * 2/2012 ..... B65D 41/0414
WO WO-2013154508 A1 * 10/2013 ..... B65D 43/0212
WO WO-2015193971 A1 * 12/2015 ..... B65D 41/04
WO WO-2016/017178 A1 2/2016
WO WO-2016017178 A1 * 2/2016 ..... B65D 5/74
WO WO-2016080898 A1 * 5/2016 ..... B29C 65/561

OTHER PUBLICATIONS

International Searching Authority, "International Search Report," issued in connection with International Patent Application No. PCT/JP2018/030110, dated Sep. 25, 2018.
International Searching Authority, "Written Opinion," issued in connection with International Patent Application No. PCT/JP2018/030110, dated Sep. 25, 2018.
Extended European Search Report dated Jul. 20, 2020 for corresponding European Patent Application No. 18842930.2.

* cited by examiner

ENLARGED VIEW OF AREA A

ENLARGED VIEW OF AREA B

ENLARGED VIEW OF AREA A

ENLARGED VIEW OF AREA B

SPOUT ASSEMBLY AND PACKAGING CONTAINER HAVING THE SPOUT ASSEMBLY

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2018/030110, filed on Aug. 10, 2018, which is based upon and claims the benefit of priority to Japanese Patent Application No. 2017-155976, filed on Aug. 10, 2017; Japanese Patent Application No. 2018-140154, filed Jul. 26, 2018; Japanese Patent Application No. 2018-146726, filed on Aug. 3, 2018; and Japanese Patent Application No. 2018-148819, filed Aug. 7, 2018, the disclosures of which are all incorporated herein by reference in their entireties.

TECHNICAL FIELD

The present invention relates to a spout assembly and a packaging container having the spout assembly.

BACKGROUND ART

Packaging containers having spout assemblies are widely used as containers for containing liquids or other contents. Such a spout assembly includes a spout welded to a container body and a cap to be threadably engaged with the spout.

PTL 1 describes a pour spout including a body made of a resin and welded to a paper container, and a screw cap made of a resin and detachable from the body. The body includes a spout having an outer periphery on which external threads are formed, a closure plate provided to the interior of the spout, and a pull ring provided to the closure plate. The screw cap includes a cylindrical part, a top plate and an inner ring. The cylindrical part has an inner surface on which internal threads are formed and is externally fitted to the spout of the body.

PTL 1 also describes that the pour spout can be produced by injection molding using a comparatively soft synthetic resin, such as polyethylene, as a material and that the gate for injecting the resin when molding the body is provided at a position of a die corresponding to the center of the closure plate.

CITATION LIST

[Patent Literature] PTL 1: JP 2016-011128 A

SUMMARY OF THE INVENTION

Technical Problem

The pour spout of PTL 1 is opened by inserting a finger into the pull ring provided to the spout, pulling the pull ring, and cutting and removing the closure plate from the spout. In the method of keeping sealing properties using the closure plate, opening is difficult depending on the size of the pull ring provided to the closure plate, or it takes time to pull out the pull ring.

The present invention aims to provide a spout assembly capable of ensuring high sealing properties with a structure in which the spout has no closure plate and to provide a packaging container having the spout assembly.

As a method of keeping sealing properties in the case of using a spout having no pull ring, the engagement between the spout and the threads of the cap may be designed to have high strength. However, increase in engagement strength between the spout and the threads raises another issue of requiring a larger force at the time of opening. If the container is made of paper, in particular, the need of applying a larger force (torque) to the container with the container being firmly held by hand raises an issue of involving difficulty at the time of opening.

The present invention aims to provide a spout assembly capable of lessening or even preventing excessive force from being required during opening, while ensuring good sealing properties, with a structure in which the spout has no closure plate and to provide a packaging container having the spout assembly.

Pour spouts in which the body has no closure plate have been proposed. However, there is room for considering the position and the shape of the gate if closure plates are eliminated. If the position and the shape of the gate are not appropriately designed, flow of the resin material in the cavity becomes unstable. It is known that this unstable flow may cause residual stresses inside the products, leading to the occurrence of deformation, such as sink marks or warpage. In particular, products with large residual stresses tend to cause cracks due to ultrasonic welding at the position where the large residual stresses have occurred.

The present invention aims to provide a spout assembly capable of lessening or even preventing the occurrence of residual stresses or the occurrence of deformation, such as sink marks or warpage, due to injection molding even when the spout assembly is structured to have a spout having no closure plate, and to provide a packaging container provided with the spout assembly.

Solution to Problem

The present invention relates to a spout assembly including a spout welded to a container body, and a cap threadably engaged with the spout. In the spout assembly, the cap includes a top plate, a side wall connected to an outer peripheral edge of the top plate and having an inner peripheral surface on which internal threads are formed, and an inner ring circumferentially provided to an inner surface of the top plate; the inner ring has an outer peripheral surface including, sequentially from the top plate, a first region having a first outer diameter, and a second region having a second outer diameter whose outermost diameter is smaller than the first outer diameter; the spout includes a side wall having an outer peripheral surface on which external threads are formed, the spout being made of a material having rigidity that is lower than that of the material for the cap; the side wall of the spout has an inner peripheral surface including, sequentially from an upper end facing away from the container body, a first region having a first inner diameter, and a second region having a second inner diameter whose innermost diameter is smaller than the first inner diameter. In a state in which the cap is threadably engaged with the spout, the first region of the inner ring is in close contact with the first region of the side wall of the spout throughout the circumference, the second region of the inner ring is in close contact with second region of the side wall of the spout throughout the circumference, a predetermined part of the inner peripheral surface of the side wall of the cap is in close contact with a predetermined part of the outer peripheral surface of the side wall of the spout, and a space is formed between an area in which the first region of the inner ring is in close contact with the first region of the side wall of the spout and an area in which the second region of the inner ring is in close contact with the second region of the side wall of the spout.

It is preferred that the cap further includes a contact ring that is formed on the top plate and positioned between the side wall of the cap and the inner ring, and that the contact ring is in close contact with an upper end of the side wall of the spout in a state in which the cap is threadably engaged with the spout.

It is preferred that, in a process of placing the cap on the spout and rotating the cap in a closing direction: the first region of the inner ring pushes the side wall of the spout outward to closely contact the inner peripheral surface of the side wall of the spout, the second region of the inner ring thereafter pushes the side wall of the spout outward even more to contact the inner peripheral surface of the side wall of the spout, and the cap is thereafter brought into a state of being threadably engaged with the spout.

It is preferred that, in a state in which the cap has been disassembled from the spout, a difference between the first outer diameter of the inner ring and the first inner diameter of the side wall of the spout is larger than a difference between the second outer diameter of the inner ring and the second inner diameter of the side wall of the spout.

It is preferred that, in a state in which the cap has been disassembled from the spout, the difference between the first outer diameter of the inner ring and the first inner diameter of the side wall of the spout is 0.30 mm or more and 0.50 mm or less; the difference between the second outer diameter of the inner ring and the second inner diameter of the side wall of the spout is of 0.10 mm or more and 0.30 mm or less; and a difference between an inner diameter of the predetermined part of the inner peripheral surface of the side wall of the cap and an outer diameter of the predetermined part of the outer peripheral surface of the side wall of the spout is 0.20 mm.

It is preferred that a thickness of the inner ring in the first region is larger than a thickness of the side wall of the spout in the first region; and a thickness of the inner ring in the second region is smaller than a thickness of the side wall of the spout in the second region.

The cap may further include a band part and one or more flaps, the band part having a cylindrical shape and being mounted to the cap via a thin part that is provided to an end of the side wall of the cap, the end of the side wall facing away from the top plate, each of the one or more flaps having a first end continuously connected to an end of the band part, the end of the band part facing away from the thin part; the spout further may include a flange and a protrusion, the flange extending outward from an end edge of the side wall of the spout, the protrusion extending outward from an area between an external thread on the outer peripheral surface of the side wall of the spout and the flange; and in a state in which the cap is threadably engaged with the spout, the end of the band part facing away from the thin part may be in close contact with the flange, and each of the one or more flaps may be held in a gap between the protrusion and the flange, the flap being in a state of being bent at the first end continuously connected to the band part, with a second end of the flap being inclined and oriented toward the top plate.

The spout may further include a flange extending outward from an end edge of the side wall of the spout; a plurality of recesses arranged on a surface of the flange facing away from the side wall of the spout, the recesses being arranged concentrically with the side wall of the spout in plan view and defined by ribs; and a gate entrance protruding downward in the axial direction of the side wall of the spout from one of the recesses to a position not beyond the surface of the flange facing away from the side wall of the spout.

Another aspect of the present invention relates to a packaging container provided with the spout assembly described above.

Advantageous Effects of the Invention

The present invention aims to provide a spout assembly capable of ensuring good sealing properties with a structure in which the spout has no closure plate and to provide a packaging container having the spout assembly.

The present invention can achieve a spout assembly capable of lessening or even preventing the increase in force required for opening the spout assembly, while ensuring good sealing properties, even with a structure in which the spout has no closure plate, and a packaging container provided with the spout assembly.

The present invention can achieve a spout assembly capable of lessening or even preventing the occurrence of residual stresses or the occurrence of deformation, such as sink marks or warpage, due to injection molding even with a structure in which the spout has no closure plate, and a packaging container provided with the spout assembly.

DETAILED DESCRIPTION

Figure 1A:
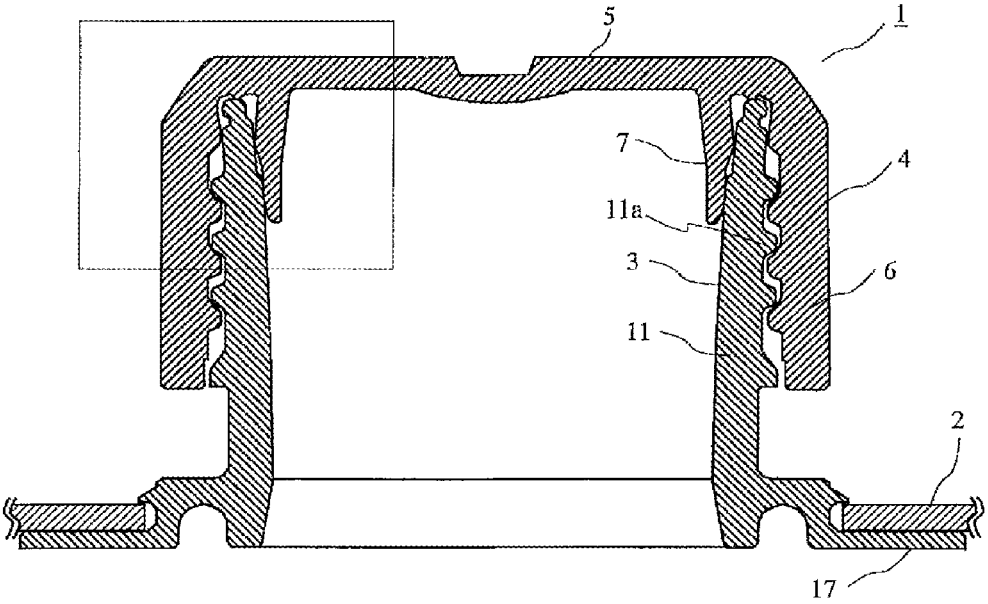
FIGS. 1A and 1B are a set of cross-sectional views each illustrating a spout assembly according to a first embodiment.

With reference to the accompanying Figures, a description will now be given of representative embodiments according to the present invention. The present invention is not limited to the following representative embodiments, and appropriate modifications can be made without departing from the spirit of the present invention. The representative embodiments described below are merely examples of the present invention, and the design thereof could be appropriately changed by one skilled in the art. Here, the drawings are schematic, and the relationship between thickness and plane size, the ratio of the thickness of each layer, etc., may be different from actual ones. The embodiments described below are merely examples of the configurations for embodying the technical idea of the present invention, and the technical idea of the present invention should not limit the materials, shapes, structures, and the like of the components to those described below. The technical idea of the present invention can be modified in various ways within the technical scope specified by the claims.

The same constituent elements are denoted by the same reference numerals unless there is a reason for the sake of convenience, and redundant description is omitted. In the drawings referred to in the following description, for clarity, characteristic parts are enlarged, and thus the components are not shown to scale. It is, however, clear that one or more embodiments can be implemented without such details. In addition, known structures and devices may be schematically represented for simplicity.

First Embodiment (Structure of Spout Assembly)

Figure 1B:
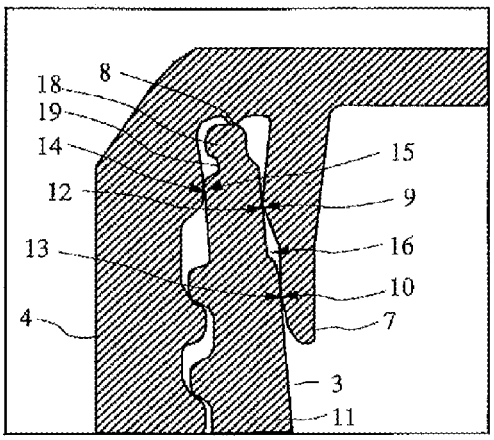
Figure 2:
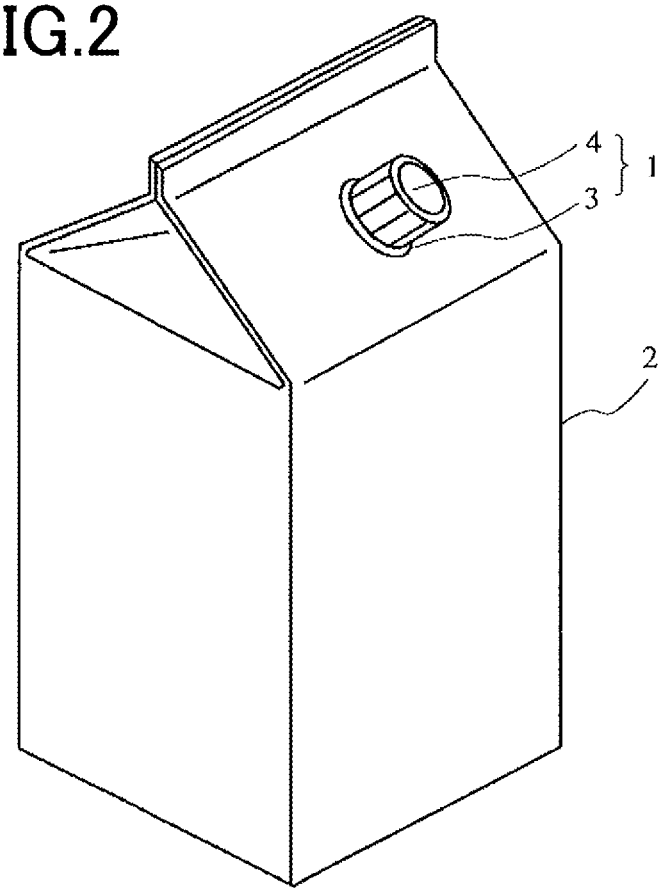
FIG. 2 is a perspective view illustrating a packaging container provided with the spout assembly according to the first embodiment.

A first embodiment of the present invention will be described. In the following description, the same or corresponding components in the embodiments are denoted by the same reference signs. FIGS. 1A and 1B are a set of cross-sectional views each illustrating a spout assembly according to the first embodiment. FIG. 1A is a cross-sectional view illustrating a spout assembly and FIG. 1B is an enlarged view illustrating the area enclosed by the rectangle in FIG. 1A. FIG. 2 is a perspective view illustrating a packaging container provided with the spout assembly according to the first embodiment. As shown in FIGS. 1A and 1B, and 2, a spout assembly 1 includes a spout 3 welded to a container body 2, and a cap 4 to be threadably engaged with the spout 3. The cap 4 includes a top plate 5, a side wall 6, an inner ring 7 and a contact ring 8. The side wall 6 is connected to an outer peripheral edge of the top plate 5 and has an inner peripheral surface on which internal threads are formed. The inner ring 7 is circumferentially provided to the inner surface of the top plate 5. The contact ring 8 is provided between the side wall 6 of the top plate 5 and the inner ring 7. The inner ring 7 has an outer peripheral surface including, sequentially from the top plate 5, a first region 9 and a second region 10. The first region 9 has a first outer diameter. The second region 10 has a second outer diameter whose outermost diameter is smaller than the first outer diameter. The spout 3 includes a side wall 11 having an outer peripheral surface on which external threads 11*a* are formed. The side wall 11 of the spout 3 has an inner peripheral surface including, sequentially from the upper end facing away from the container body 2, a first region 12 and a second region 13. The first region 12 has a first inner diameter. The second region 13 has a second inner diameter whose innermost diameter is smaller than the first inner diameter.

As shown in FIG. 1B, in a state in which the cap 4 is threadably engaged with the spout 3, the first region 9 of the inner ring 7 is in close contact with the first region 12 of the side wall 11 of the spout 3 throughout the circumference, and the second region 10 of the inner ring 7 is in close contact with the second region 13 of the side wall 11 of the spout 3 throughout the circumference.

In a state in which the cap 4 is threadably engaged with the spout 3, a predetermined part 14 of the inner peripheral surface of the side wall 6 of the cap 4 is in close contact with a predetermined part 15 of the outer peripheral surface of the side wall 11 of the spout 3 throughout the circumference. The predetermined part 14 of the inner peripheral surface of the side wall 6 of the cap 4 is formed between a joint of the side wall 6 and the top plate 5, and an internal thread nearest to the top plate 5. The predetermined part 15 of the outer peripheral surface of the side wall 11 of the spout 3 is formed between the upper end of the side wall 11 facing away from the container body 2 and an external thread 11*a* nearest to the upper end. In a state in which the cap 4 is threadably engaged with the spout 3, the contact ring 8 of the cap 4 is in close contact with the upper end of the side wall 11 of the spout 3.

Specifically, in a state in which the cap 4 is threadably engaged with the spout 3, the container body 2 is sealed by four close contacts. They are the close contact between the first region 9 of the inner ring 7 and the first region 12 of the side wall 11 of the spout 3, the close contact between the second region 10 of the inner ring 7 and the second region 13 of the side wall 11 of the spout 3, the close contact between the predetermined part 14 of the inner peripheral surface of the side wall 6 of the cap 4 and the predetermined part 15 of the outer peripheral surface of the side wall 11 of the spout 3, and the close contact between the contact ring 8 and the upper end of the side wall 11 of the spout 3.

In a state in which the cap 4 is threadably engaged with the spout 3, there is a space 16 between a region where the first region 9 of the inner ring 7 is in close contact with the first region 12 of the side wall 11 of the spout 3 and a region where the second region 10 of the inner ring 7 is in close contact with the second region 13 of the side wall 11 of the spout 3. Provision of the space 16 can provide two reliable close contact regions throughout the circumference, between the outer peripheral surface of the inner ring 7 and the inner peripheral surface of the side wall 11 of the spout 3.

The spout 3 is made of a material whose rigidity is lower than the rigidity of the material for the cap 4. For example, the material for the spout 3 may be low density polyethylene or straight-chain low density polyethylene. The material for the cap 4 may be, for example, polypropylene. However, materials for the spout 3 and the cap 4 are not limited to these materials. When the spout 3 is made of a material whose rigidity (flexural modulus) is lower (smaller) than the rigidity of the material for the cap 4, it is preferred that the material for the spout 3 has a flexural modulus in the range of 100 MPa or more and 1,200 MPa or less and the material for the cap 4 has a flexural modulus in the range of 1,000 MPa or more and 2,100 MPa or less.

The side wall 11 of the spout 3 has a lower end edge which is provided with a flange 17 extending outward. The flange 17 serves as a joint between the container body 2 and the spout 3 mounted to the container body 2.

(Process of Threadably Engaging the Cap with the Spout)

Figure 3A:
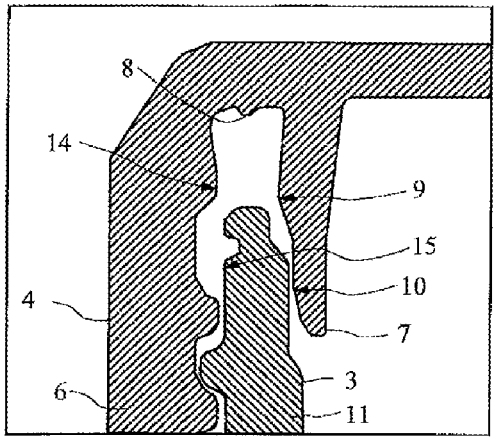
FIGS. 3A, 3B, 3C, and 3D are a set of diagrams each illustrating a process of threadably engaging a cap with a spout according to the first embodiment.
Figure 3B:
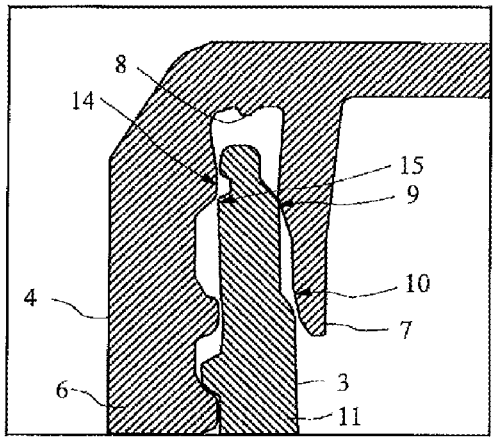
Figure 3C:
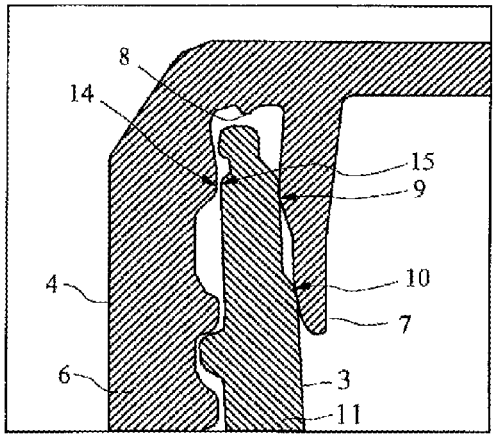
Figure 3D:
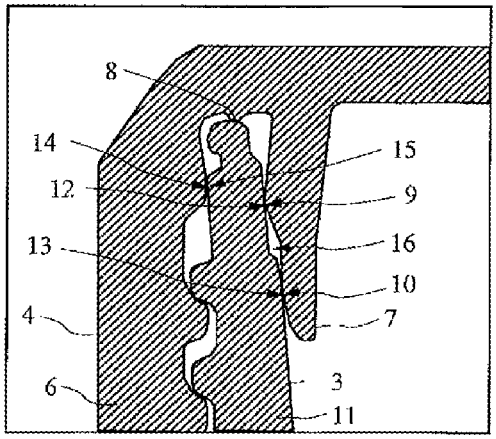
Figure 4:
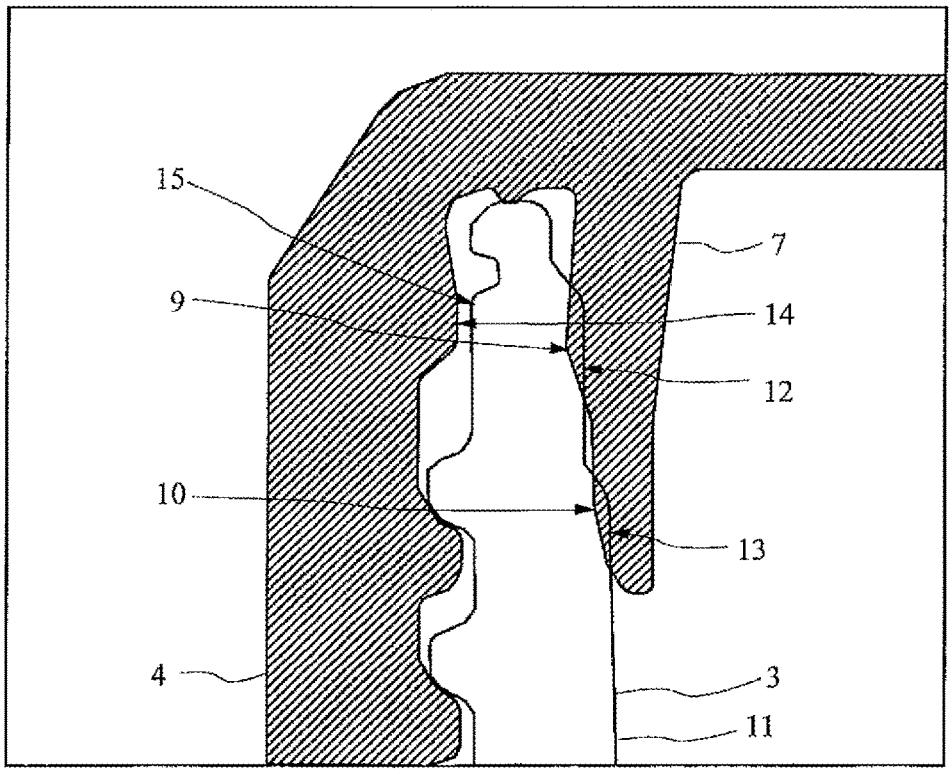
FIG. 4 is a schematic diagram in which a cross section of a cap is superimposed upon a cross section of a spout.

Referring to FIGS. 3A, 3B, 3C, 3D, and 4, the following description explains a process of threadably engaging the cap 4 with the spout 3 and a sealed state of the container 2. FIGS. 3A, 3B, 3C, and 3D are diagrams each illustrating a process of threadably engaging a cap with a spout according to the first embodiment. FIGS. 3A, 3B, 3C, and 3D are enlarged views each illustrating the area enclosed by the rectangle in FIG. 1A. FIG. 4 is a schematic diagram in which a cross section of a cap is superimposed upon a cross section of a spout. FIG. 4 is a schematic diagram corresponding to the area enclosed by the rectangle in FIG. 1A. In FIG. 4, the cross sections of a cap and a spout are superimposed with each other in a state in which the cap has been disassembled from the spout. For ease of understanding, the cross section of the cap 4 is hatched and the cross section of the spout 3 is not hatched.

To threadably engage the cap 4 with the spout 3, first, as shown in FIG. 3A, the upper end of the side wall 11 of the spout 3 is inserted into the cap 4 so as to be located radially inside the side wall 6. When the cap 4 is placed on the spout 3 and rotated in the closing direction, the upper end of the side wall 11 of the spout 3 is partially inserted between the side wall 6 of the cap 4 and the inner ring 7. In this case, the first region 9 of the inner ring 7 is not in contact with the inner peripheral surface of the side wall 11 of the spout 3. Also, there is no contact between the second region 10 of the inner ring 7 and the inner peripheral surface of the side wall 11 of the spout 3, between the predetermined part 14 of the inner peripheral surface of the side wall 6 of the cap 4 and the predetermined part 15 of the outer peripheral surface of the side wall 11 of the spout 3, or between the contact ring 8 and the upper end of the side wall 11 of the spout 3.

After that, as shown in FIG. 3B, when the cap 4 is further rotated in the closing direction, the first region 9 of the inner ring 7 pushes the side wall 11 of the spout 3 outward and contacts the inner peripheral surface of the side wall 11 of the spout 3. In this case, there is no contact between the second region 10 of the inner ring 7 and the inner peripheral surface of the side wall 11 of the spout 3, between the predetermined part 14 of the inner peripheral surface of the side wall 6 of the cap 4 and the predetermined part 15 of the outer peripheral surface of the side wall 11 of the spout 3, or between the contact ring 8 and the upper end of the side wall 11 of the spout 3.

As shown in FIG. 4, the first outer diameter of the first region 9 of the inner ring 7 is larger than the inner diameter of a region in the inner peripheral surface of the side wall 11 of the spout 3, as shown in FIG. 3B, with which the first region 9 of the inner ring 7 contacts. As mentioned above, the spout 3 is made of a material whose rigidity is lower than the rigidity of the material for the cap 4. Therefore, when inserting the inner ring 7 into the spout 3, the first region 9 of the inner ring 7 pushes the inner peripheral surface of the side wall 11 of the spout 3 outward, with which the first region 9 of the inner ring 7 is in contact.

After that, as shown in FIG. 3C, when the cap 4 is further rotated in the closing direction, the second region 10 of the inner ring 7 pushes the side wall 11 of the spout 3 outward and contacts the inner peripheral surface of the side wall 11 of the spout 3. Also, the first region 9 of the inner ring 7 further pushes the side wall 11 of the spout 3 outward. In this case, there is no contact between the predetermined part 14 of the inner peripheral surface of the side wall 6 of the cap 4 and the predetermined part 15 of the outer peripheral surface of the side wall 11 of the spout 3, and between the contact ring 8 and the upper end of the side wall 11 of the spout 3.

As shown in FIG. 4, the second outer diameter of the second region 10 of the inner ring 7 is larger than the inner diameter of a region in the inner peripheral surface of the side wall 11 of the spout 3, as shown in FIG. 3C, with which the second region 10 of the inner ring 7 contacts. As mentioned above, the spout 3 is made of a material whose rigidity is lower than the rigidity of the material for the cap 4. Therefore, when inserting the inner ring 7 into the spout 3, the second region 10 of the inner ring 7 pushes the inner peripheral surface of the side wall 11 of the spout 3 outward, with which the second region 10 of the inner ring 7 is in contact.

After that, as shown in FIG. 3D, when the cap 4 is further rotated in the closing direction, the cap 4 is brought into a state of being threadably engaged with the spout 3. Specifically, the first region 9 of the inner ring 7 is brought into a state of closely contacting the first region 12 of the side wall 6 of the spout 3 throughout the circumference, the second region 10 of the inner ring 7 is brought into a state of closely contacting the second region 13 of the side wall 11 of the spout 3 throughout the circumference, the predetermined part 14 of the inner peripheral surface of the side wall 6 of the cap 4 is brought into a state of closely contacting the predetermined part 15 of the outer peripheral surface of the side wall 11 of the spout 3, and the contact ring 8 is brought into a state of closely contacting the upper end of the side wall 11 of the spout 3. It should be noted that FIG. 3D is the same as FIG. 1B.

The first region 9 of the inner ring 7 pushes the side wall 11 of the spout 3 outward in the states shown in both FIGS. 3B and 3C and then closely contacts the first region 12 of the side wall 11 of the spout 3 throughout the circumference in the state shown in FIG. 3D. The second region 10 of the inner ring 7 is not in contact with the inner peripheral surface of the side wall 11 of the spout 3 in the state shown in FIG. 3B, but pushes the side wall 11 of the spout 3 outward in the state shown in FIG. 3C and then contacts the second region 13 of the side wall 11 of the spout 3 throughout the circumference in the state shown in FIG. 3D. Thus, as shown in FIG. 4, in the state in which the cap 4 has been disassembled from the spout 3, the difference between the first outer diameter of the first region 9 of the inner ring 7 and the first inner diameter of the first region 12 of the side wall 11 of the spout 3 is larger than the difference between the second outer diameter of the second region 10 of the inner ring 7 and the second inner diameter of the second region 13 of the side wall 11 of the spout 3. With this configuration, while the first and second regions 9 and 10 of the inner ring 7 are ensured to contact the inner peripheral surface of the side wall 11 of the spout 3, the pressure exerted is balanced between the two-location pressure of the first region 9 against the inner peripheral surface of the side wall 11 of the spout 3 and the one-location pressure of the second region 10 against the side wall 11 of the spout 3.

When the difference between the first outer diameter of the inner ring 7 and the first inner diameter of the side wall 11 of the spout 3 is larger than the difference between the second outer diameter of the inner ring 7 and the second inner diameter of the side wall 11 of the spout 3, it is preferred that these differences are each in the range of 0.10 mm or more and 0.50 mm or less. As an example, the difference between the first outer diameter and the first inner diameter may be in the range of 0.30 mm or more and 0.50 mm or less, and the difference between the second outer diameter and the second inner diameter may be in the range of 0.10 mm or more and 0.30 mm or less, while the difference between the inner diameter of the predetermined part 14 and the outer diameter of the predetermined part 15 may be 0.20 mm. When the differences between the first outer diameter and the first inner diameter and between the second outer diameter and the second inner diameter are designed to be in the above ranges, higher sealing properties may be ensured. It should be note that the inner diameter and the outer diameter mentioned above refer to an inner diameter and an outer diameter in a diameter direction.

In a state in which the cap 4 is threadably engaged with the spout 3, if the outer peripheral surface of the inner ring 7 is in contact with the inner peripheral surface of the side wall 11 of the spout 3 via only one contact area having a predetermined length in the direction parallel to the center axis of the cap 4, there may be portions in this contact area where these surfaces are in contact and portions not in contact with each other. In other words, gaps may be formed in the contact area. These gaps may communicate each other to bring the container body 2 into an unsealed state.

According to the spout assembly 1 of the first embodiment, the first and second regions 9 and 10 of the inner ring 7 push the side wall 11 of the spout 3 outward and are respectively closely brought into contact with the first and second regions 12 and 13 of the side wall 11 of the spout 3 with the space 16 being sandwiched between these contacts. Thus, two reliable close contact areas can be provided between the outer peripheral surface of the inner ring 7 and the inner peripheral surface of the spout 3 throughout the circumference. Therefore, good sealing properties can be ensured with a structure in which no closure plate is provided to the spout 3.

Furthermore, according to the spout assembly 1 of the first embodiment, two reliable close contact areas can be provided between the outer peripheral surface of the inner ring 7 and the inner peripheral surface of the spout 3 throughout the circumference not only before opening of the spout assembly 1 but also after closing it following the opening.

Furthermore, even when the container body 2 that holds contents is dropped on the floor or the like, the spout assembly 1 reliably maintains the two close contact areas throughout the circumference with the space 16 being sandwiched therebetween. Therefore, even if the contents enter the space 16 via the first close contact area between the second region 10 of the inner ring 7 and the second region 13 of the side wall 11 of the spout 3, the spout assembly 1 still has the second close contact area between the first region 9 of the inner rig 7 and the first region 12 of the side wall 11 of the spout 3. Specifically, since close contact areas are doubly formed between the outer peripheral surface of the inner ring 7 and the inner peripheral surface of the side wall 11 of the spout 3, the contents can be prevented from flowing out of the container body 2 via these close contact areas even with a structure in which the spout 3 has no closure plate.

In the process of threadably engaging the cap 4 with the spout 3, the first region 9 of the inner ring 7 closely contacts the first region 12 of the side wall 11 of the spout 3, and then the second region 10 of the inner ring 7 closely contacts the second region 13 of the side wall 11 of the spout 3. Thus, when forming the space 16, air is permitted to escape from the space 16 into the container body 2 and only a small amount of air stays inside the space 16. This realizes a packaging container provided with the spout assembly 1 exerting only small resistance when the cap 4 is tightened.

When high temperature contents have been filled in the packaging container, the whole container may be sprayed with cooling water to cool the contents. In this case, the spray of cooling water may enter a gap between the cap 4 and the spout 3. According to the spout assembly 1 of the first embodiment, in a state in which the cap 4 is threadably engaged with the spout 3, the predetermined part 14 of the inner peripheral surface of the side wall 6 of the cap 4 is in close contact with the predetermined part 15 of the outer peripheral surface of the side wall 11 of the spout 3 throughout the circumference. Therefore, the cooling water that has entered the gap between the cap 4 and the spout 3 cannot advance to the upper end or the interior of the spout 3 via the close contact area between the predetermined parts 14 and 15. As a result, the upper end or the interior of the spout 3 is prevented from being contaminated by the cooling water.

As shown in FIG. 1B, a protrusion 18 and a groove 19 may further be provided to the upper end of the side wall 11 of the spout 3 to prevent dripping. The groove 19 may be formed on the flange 17 side outer peripheral surface of the protrusion 18. In the case of providing the protrusion 18 and the groove 19, the predetermined part 15 of the outer peripheral surface of the side wall 11 of the spout 3 may preferably be formed between the groove 19 and the uppermost external thread 11*a*. Thus, the protrusion 18 and the groove 19 for preventing dripping are prevented from being sprayed with cooling water. Therefore, residue of the cooling water that would otherwise have adhered to the protrusion 18 and the groove 19 is prevented from being mixed into the contents when the contents are poured.

Furthermore, the inner diameter of the protrusion 18 may be made larger than that of the first region 12 of the side wall 11, and the outer diameter of the protrusion 18 may be made smaller than that of the predetermined part 15. Thus, gaps formed between the protrusion 18 and the predetermined part 14 of the cap 4 and between the protrusion 18 and the first region 9 can be ensured to be larger. Therefore, when the side wall 11 is pushed outward by the inner ring 7 in the process of the threadable engagement described above, the torque applied to the cap 4 is prevented from increasing due to the upper end of the side wall 11 abutting against the predetermined part 14 of the cap 4.

Provision of the groove 19 may enable bending of the protrusion 18 in the vicinity of the groove 19 when the upper end of the protrusion 18 abuts against the side wall 6 of the cap 4, top plate 15 or the like. This may prevent deterioration of sealing properties due to formation of a gap between the second region 10 of the inner ring 7 and the second region 13 of the side wall 11 by the protrusion 18 abutting against the side wall 6 of the cap 4, the top plate 15 or the like and thus by the side wall 6 being pushed inward toward the first region 9 of the inner ring 7 during the threadable engagement process.

In the structure of the above embodiment, the spout 3 is made of a material having a flexural modulus lower than that of the material for the cap 4 so that the rigidity of the side wall 11 is lower than that of the inner ring 7. Thus, good sealing properties are ensured with a structure in which the spout 3 has no closure plate. In addition to or in place of this structure, the thicknesses of the inner ring 7 and the side wall 11 in the radial direction may be suitably determined so that the rigidity of the side wall 11 will be lower than that of the inner ring 7. For example, the thickness of the inner ring 7 in the radial direction in the first region 9 may be made larger than the thickness of the side wall 11 in the radial direction in the first region 12. Furthermore, the thickness in the radial direction in the second region 10 may be made smaller than the thickness of the side wall 11 in the radial direction in the second region 13. By suitably determining the thicknesses, the rigidity of the first region 12 of the side wall 6 can be made lower than the rigidity of the first region 9 of the inner ring 7 even when the materials used for the spout 3 and the cap 4 respectively have flexural moduli of about the same level.

As described above, according to the spout assembly and the packaging container provided with the spout assembly of the present invention, good sealing properties can be ensured with a structure in which the spout has no closure plate. Furthermore, good sealing properties can be ensured not only before opening of the spout assembly 1 but also after closing it following opening, so that, when the packaging container is dropped, the contents are prevented from flowing out of the spout assembly.

To impart an anti-tamper function for clarifying whether the packaging container has been opened previously, a temper evident band may be provided to the lower end of the side wall of the cap. Known tamper evident bands may be used for this purpose.

Second Embodiment (Spout Assembly)

Figure 5:
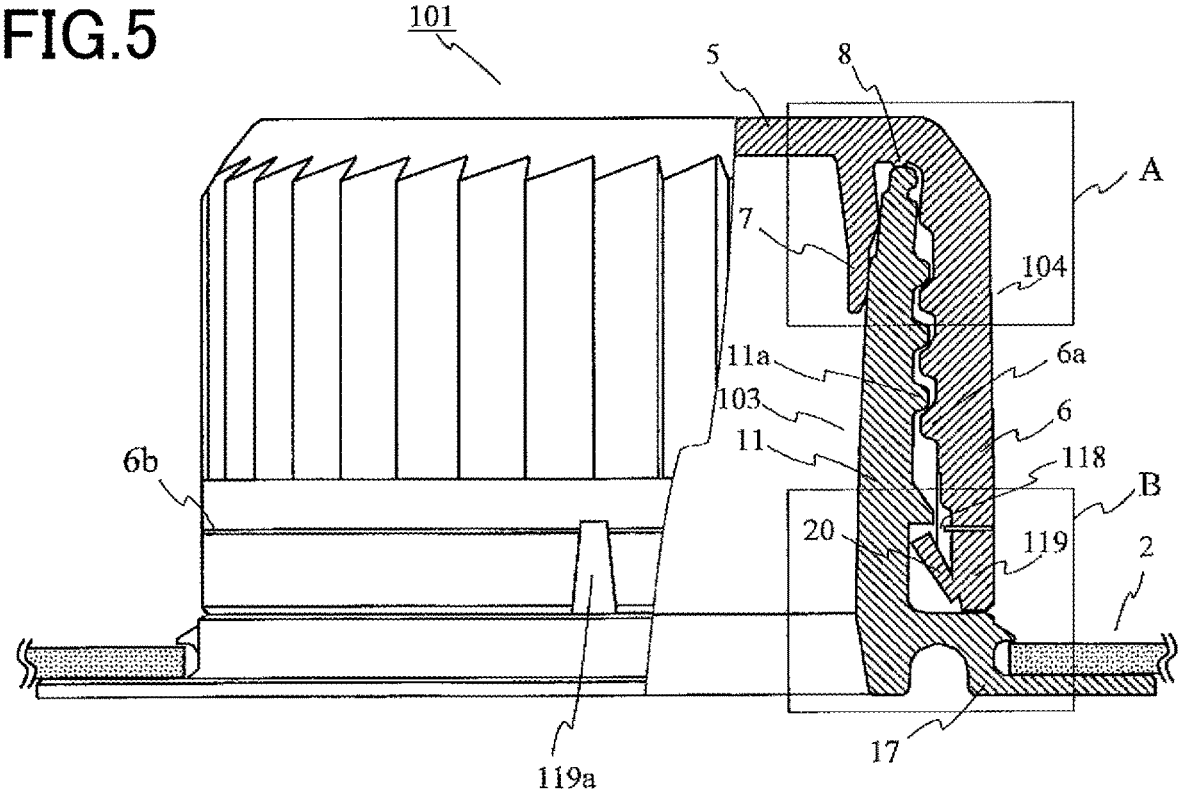
FIG. 5 is a partial cross-sectional view illustrating a spout assembly according to a second embodiment.
Figure 6:
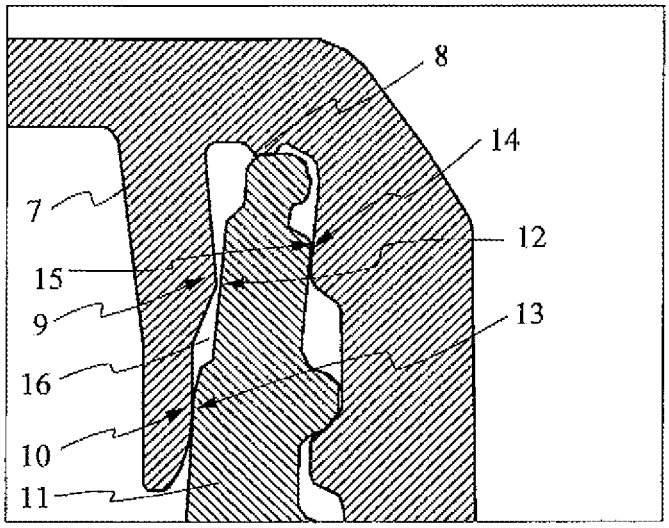
FIG. 6 is an enlarged cross-sectional view illustrating the spout assembly according to the second embodiment.
Figure 7:
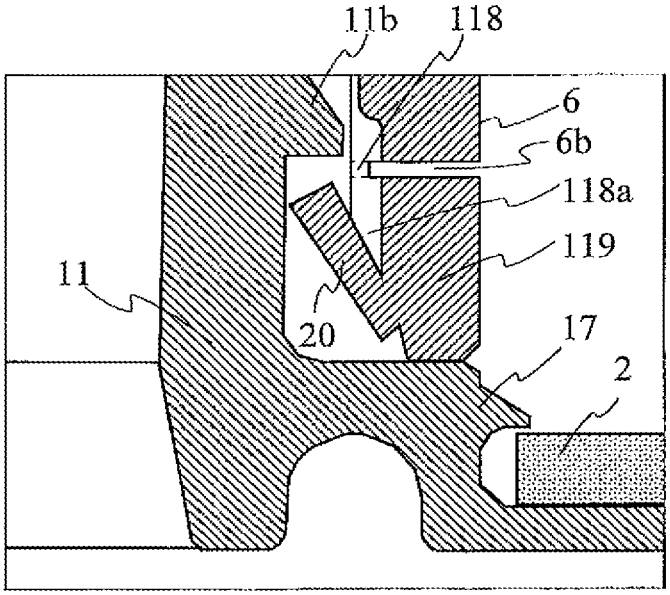
FIG. 7 is an enlarged cross-sectional view illustrating the spout assembly according to the second embodiment.
Figure 8:
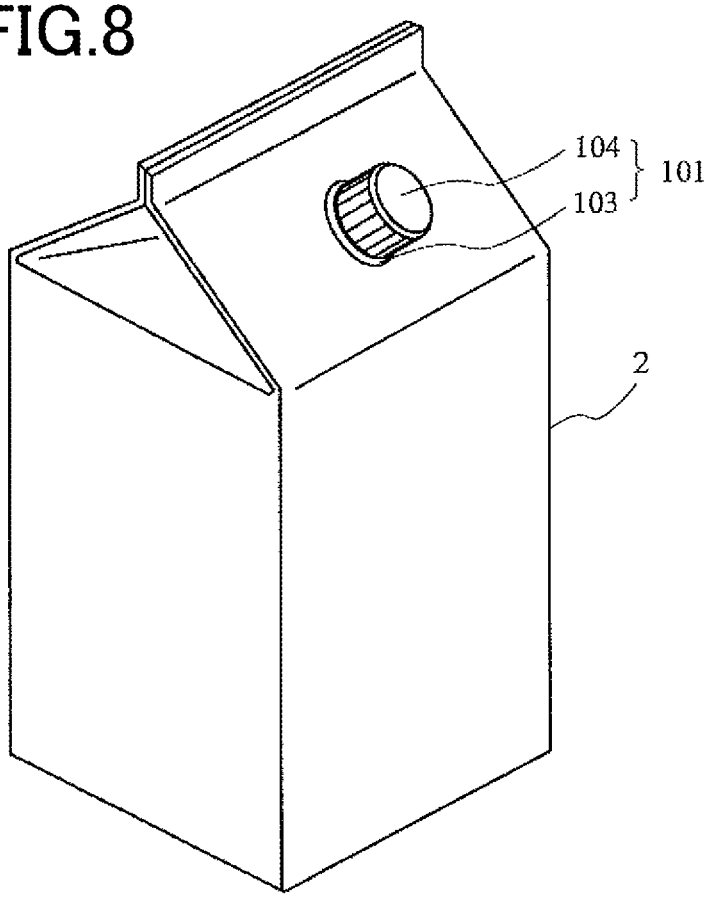
FIG. 8 is a perspective view illustrating a packaging container provided with the spout assembly according to the second embodiment.

A second embodiment of the present invention will be described. FIG. 5 is a partial cross-sectional view illustrating a spout assembly according to the second embodiment. FIGS. 6 and 7 are enlarged cross-sectional views respectively illustrating the area A and the area B enclosed by the rectangles in FIG. 5. FIG. 8 is a perspective view illustrating a packaging container provided with the spout assembly of the present embodiment.

As shown in FIGS. 5 and 8, a spout assembly 101 includes a spout 103 welded to a container body 2, and a cap 104 to be threadably engaged with the spout 103. FIGS. 5 to 8 each show a state in which the cap 104 has been assembled to the spout 103. The expression "a state in which the cap 104 has been assembled to the spout 103" refers to a state in which the cap 104 is threadably engaged with the spout 103 and movement in the height direction of the cap 104 has been restrained by a protrusion 11*b* described later.

(Cap)

The cap 104 includes a top plate 5, a side wall 6, an inner ring 7 and a contact ring 8. The side wall 6 is connected to an outer peripheral edge of the top plate 5 and has an inner peripheral surface on which internal threads 6*a* are formed. The inner ring 7 has a cylindrical shape and is circumferentially provided to the top plate 5. The contact ring 8 is provided between the side wall 6 of the top plate 5 and the inner ring 7. The cap 104 has a lower end facing away from the top plate 5 of the side wall 6 and provided with a cylindrical band part 119 via a thin part 118. The band part 119 has a lower end facing away from the thin part 118 and provided with a flap 20 whose one end continues from the band part 119. The lower end of the band part 119 may be provided with one or more communication parts 119*a* for establishing communication between the interior and the exterior of the cap 104.

The band part 119 serves as a tamper evidence band which is separable from the cap 104 by breaking of the thin part 118 at the time of opening. As an example, as shown in FIG. 7, the thin part 118 may be constituted by a plurality of ribs 118*a* circumferentially arranged at predetermined intervals on the inner peripheral surfaces of the side wall 6 of the cap 104 and the band part 119 and connecting the side wall 6 to the band part 119. Although the detail will be described later, the strength of the thin part 118 corresponding to the force required for opening the spout assembly may be suitably changed by controlling the thickness of the ribs 118*a* in the radial direction by forming a groove 6*b* (also termed a score cut) from the outer peripheral surface of the cap 104 toward the ribs 118*a* in the process of assembling the cap. As shown in FIG. 5, the groove 6*b* may be formed throughout the circumference.

The flap 20 serves as a member that abuts against a protrusion 11*b*, described later, and breaks the thin part 118 when opening the spout assembly to permit the band part 119 to remain at the spout 103 or the cap 104. One or more flaps 20 may be circumferentially provided to the lower end of the band part 119 at predetermined intervals. Provision of a plurality of flaps 20 can reduce (disperse) the reaction force at the time of assembling (setting) the cap 104 to the spout 103 before use by threading or by other methods.

The communication part 119*a* serves as a notch for dividing the band part 119 and as a hole for discharging cooling water from the gap between the cap 104 and the spout 103 that has entered therefrom. Cooling water is a liquid used for showering the container body 2 to cool high temperature contents that have been filled in the container body 2. By providing the communication part 119*a*, the upper end or the interior of the spout 103 is prevented from being polluted by the cooling water. It should be noted that the communication part 119*a* does not have to be necessarily provided.

(Spout)

The spout 103 includes a cylindrical side wall 11, a flange 17 extending outward from one end edge of the side wall 11, external threads 11*a* formed on the outer peripheral surface of the side wall 11, and a protrusion 11*b* protruding outward from an area between an external thread 11*a* on the outer peripheral surface of the side wall 11 and the flange 17.

The flange 17 serves as a joint when the spout 103 is mounted to the container body 2. As shown in FIGS. 5 and 7, the flange 17 has a thickness which is made larger in the vicinity of the side wall 11 than in the remaining portion to enable adhesion to (close contact with) the band part 119. To join the flange 17 and the container body 2 together, a known technique, such as ultrasonic welding or adhesion, may be used.

The protrusion 11*b* is a portion that abuts against the flap 20 at the time of opening. The protrusion 11*b* may be continuously formed or may be intermittently formed at predetermined intervals, as long as it can be formed in the circumferential direction of the outer peripheral surface of the side wall 11 and can abut against the flap 20 to restrain the movement of the band part 119.

(About Assembled State)

As shown in FIGS. 5 to 7, in a state in which the cap 104 has been assembled to the spout 103, the outer peripheral surface of the inner ring 7 is in close contact with the inner peripheral surface of the side wall 11 of the spout 103. Also, the lower end of the band part 119 is in close contact with the flange 17. Furthermore, the flap 20 is held in a gap between the protrusion 11*b* and the flange 17 in a state of being bent at an end portion continuously connected to the band part 119, with the other end thereof being oriented to the top plate 5.

It is preferred that the adhesion strength between the outer peripheral surface of the inner ring 7 and the inner peripheral surface of the side wall 11 of the spout 103 is at a level of not causing the contents liquid of the container body 2 to leak out from between the adhesion surfaces. Also, it is preferred that the adhesion between the band part 119 and the flange 17 induces friction therebetween that is at a level of not loosening the threadable engagement due to the assembled cap 104 being rotated by vibration or the like during the distribution process.

Thus, good sealing properties can be ensured with a structure in which the spout 103 has no closure plate, by bringing the outer peripheral surface of the inner ring 7 into close contact with the inner peripheral surface of the spout 103. Since the adhesion between the lower end of the band part 119 and the flange 17 produces friction between the cap 104 and the flange 17, threadable engagement of the assembled cap 104 is prevented from loosening. Furthermore, since an end of the flap 20 is held in the gap between the protrusion 11*b* and the flange 17 and thus movement in the height direction of the cap 104 is restrained, decrease in adhesion strength is minimized between the outer peripheral surface of the inner ring 7 and the inner peripheral surface of the spout 103. Therefore, good sealing properties can be ensured with a structure in which the spout has no closure plate.

(Inner Ring and Shape of Side Wall)

To enhance adhesion strength between the outer peripheral surface of the inner ring 7 and the inner peripheral surface of the side wall 11 of the spout 103 in the spout assembly 101, as shown in FIG. 6, the outer peripheral surface of the inner ring 7 includes, sequentially from the top plate 5, a first region 9 and a second region 10 throughout the circumference. The first region 9 has a first outer diameter and the second region 10 has a second outer diameter whose outermost diameter is smaller than the first diameter. Similarly, the inner peripheral surface of the side wall 11 of the spout 103 includes, sequentially from the upper end facing away from the container body 2, a first region 12 and a second region 13 throughout the circumference. The first region 12 has a first inner diameter and the second region 13 has a second inner diameter whose innermost diameter is smaller than the first inner diameter.

As shown in FIGS. 5 and 6, in a state in which the cap 104 has been assembled to the spout 103, the first region 9 of the inner ring 7 can closely contact the first region 12 of the side wall 11 of the spout 103 throughout the circumference, and the second region 10 of the inner ring 7 can closely contact the second region 13 of the side wall 11 of the spout 103 throughout the circumference.

In a state in which the cap 104 has been assembled to the spout 103, the predetermined part 14 of the inner peripheral surface of the side wall 6 of the cap 104 can also closely contact the predetermined part 15 of the outer peripheral surface of the side wall 11 of the spout 103 throughout the circumference. In the inner peripheral surface of the side wall 6 of the cap 104, the predetermined part 14 corresponds to a portion between a joint of the side wall 6 and the top plate 5, and the top plate 5 side end of the inner threads 6*a*. The predetermined part 15 corresponds to a portion between the upper end of the side wall 11 facing away from the flange 17 and the upper end of the external threads 11*a*. In a state in which the cap 104 is threadably engaged with the spout 103, the contact ring 8 of the cap 104 is in close contact with the upper end of the side wall 11 of the spout 103.

Specifically, in a state in which the cap 104 has been assembled to the spout 103, four close contacts can be achieved between the cap 104 and the spout 103. They are the close contact between the first region 9 of the inner ring 7 and the first region 12 of the spout 103, the close contact between the second region 10 of the inner ring 7 and the second region 13 of the spout 103, the close contact between the predetermined part 14 of the cap 104 and the predetermined part 15 of the spout 103, and the close contact between the contact ring 8 and the upper end of the side wall 11 of the spout 103.

As shown in FIG. 6, the inner ring 7 and the side wall 11 of the spout 103 may be formed so that a space 16 is formed between an area in which the first region 9 of the inner ring 7 is in close contact with the first region 12 of the spout 103 and an area where the second region 10 of the inner ring 7 is in close contact with the second region 13 of the spout 103 in a state in which the cap 104 has been assembled to the spout 103. Formation of the space 16 can provide two reliable close contact areas between the outer peripheral surface of the inner ring 7 and the inner peripheral surface of the side wall 11 of the spout 103 throughout the circumference.

To enhance the adhesion strength between the spout 103 and the cap 104, the spout 103 may be formed using a material whose rigidity is lower than that of the material for the cap 104. For example, the material for the spout 103 may be low density polyethylene or straight-chain low density polyethylene. The material for the cap 104 may be, for example, polypropylene. However, materials for the spout 103 and the cap 104 are not limited to these materials. When the spout 103 is made of a material whose rigidity (flexural modulus) is smaller than the rigidity of the material for the cap 104, it is preferred that the material for the spout 103 has a flexural modulus in the range of 100 MPa or more and 1,200 MPa or less and the material for the cap 104 has a flexural modulus in the range of 1,000 MPa or more and 2,100 MPa or less.

(Process of Assembling the Cap)

Referring to FIGS. 9A, 9B, 9C, and 9D, a process of assembling the cap 104 to the spout 103 will be described. FIGS. 9A, 9B, 9C, and 9D are diagrams each illustrating a process of assembling a cap to a spout according to the present embodiment. FIGS. 9A, 9B, 9C, and 9D are enlarged views illustrating the areas A and B enclosed by the rectangles in FIG. 5.

As will be described later, the thin part 118 of the cap 104 is formed by providing the groove 6*b* after assembling the cap 104 to the spout 103. Although there are no structures corresponding to the thin part 118 and the band part 119 of the cap 104 in the process shown in FIGS. 9A, 9B, and 9C, the part that would serve as the band part 119 after forming the groove 6*b* is indicated as a band part forming portion 119' for the sake of ease of understanding.

The following explanation will be given using a cap 104 provided with the first and second regions 9 and 10, and a spout 103 provided with the first and second regions 12 and 13. However, the shapes of the cap 104 and the spout 103 are not limited as long as the outer peripheral surface of the inner ring 7 closely contacts the inner peripheral surface of the side wall 11 of the spout 103 in the threadably engaged state.

Figure 9A:
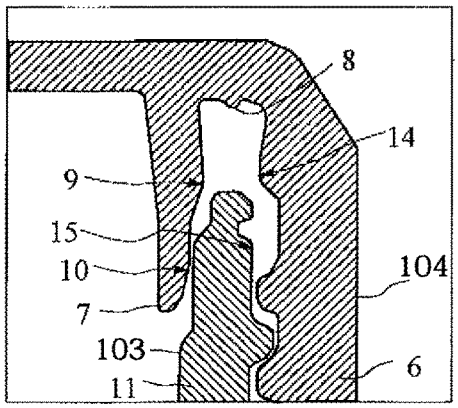
FIGS. 9A, 9B, 9C, and 9D are a set of diagrams each illustrating a process of mounting a cap to the spout assembly according to the second embodiment.
Figure 9A:
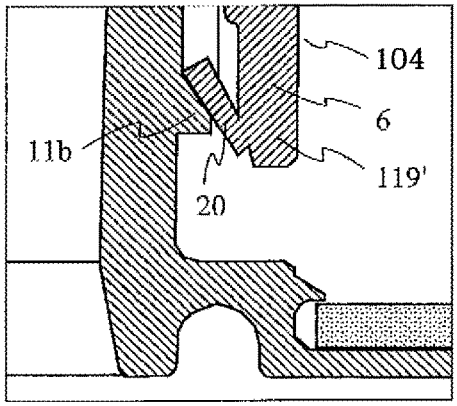

First of all, as shown in FIG. 9A, the upper end of the side wall 11 of the spout 103 is inserted into the cap 104 so as to be located radially inside the side wall 6. The cap 104 is rotated in the closing direction. Then, the cap 104 moves downward, so that, at the lower end, the flap 20 starts to contact the protrusion 11*b* in a state of being bent at an end portion continuously connected to the band part forming portion 119'. Furthermore, a part of the upper end of the side wall 11 of the spout 103 is inserted between the side wall 6 of the cap 104 and the inner ring 7. In this case, the first region 9 of the inner ring 7 is not in contact with the inner peripheral surface of the side wall 11 of the spout 103. Also, there is no contact between the second region 10 of the inner ring 7 and the inner peripheral surface of the side wall 11 of the spout 103, between the predetermined part 14 of the inner peripheral surface of the side wall 6 of the cap 104 and the predetermined part 15 of the outer peripheral surface of the side wall 11 of the spout 103, or between the contact ring 8 and the upper end of the side wall 11 of the spout 103.

Figure 9B:
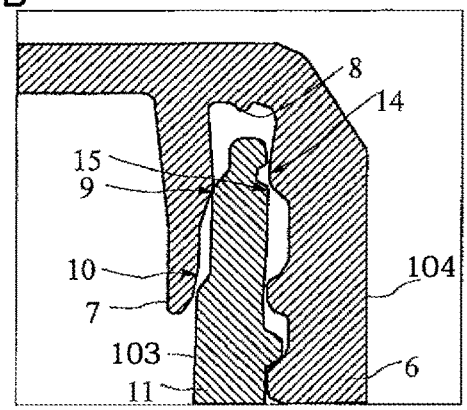
Figure 9B:
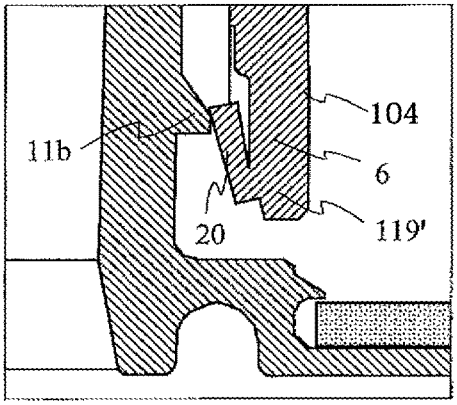

The cap 104 is further rotated in the closing direction. Then, as shown in FIG. 9B, at the lower end of the side wall 6 of the cap 104, the flap 20 moves downward over the protrusion 11*b*. Also, the first region 9 of the inner ring 7 pushes the side wall 11 of the spout 103 outward so as to be in contact with the inner peripheral surface of the side wall 11 of the spout 103. In this case, there is no contact between the second region 10 of the inner ring 7 and the inner peripheral surface of the side wall 11 of the spout 103, between the predetermined part 14 of the inner peripheral surface of the side wall 6 of the cap 104 and the predetermined part 15 of the outer peripheral surface of the side wall 11 of the spout 103, or between the contact ring 8 and the upper end of the side wall 11 of the spout 103. Also, in this case, the first region 9 of the inner ring 7 pushes the inner peripheral surface of the side wall 11 of the spout 103 outward, with which the first region 9 of the inner ring 7 is in contact.

Figure 9C:
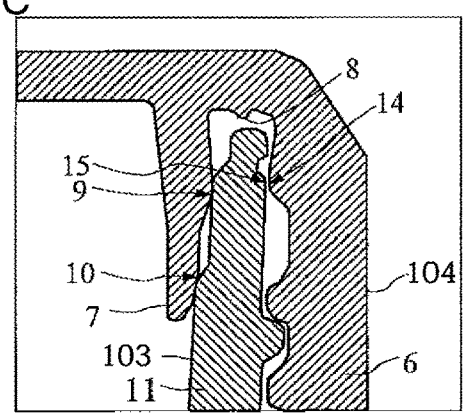
Figure 9C:
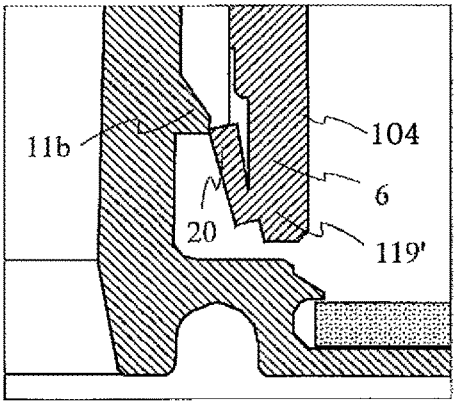

The cap 104 is further rotated in the closing direction. Then, as shown in FIG. 9C, at the lower end of the side wall 6 of the cap 104, the flap 20 moves downward even more over the protrusion 11*b*. Also, the second region 10 of the inner ring 7 pushes the side wall 11 of the spout 103 outward so as to be in contact with the inner peripheral surface of the side wall 11 of the spout 103. Furthermore, the first region 9 of the inner ring 7 pushes the side wall 11 of the spout 103 outward even more. In this case, there is no contact between the predetermined part 14 of the inner peripheral surface of the side wall 6 of the cap 104 and the predetermined part 15 of the outer peripheral surface of the side wall 11 of the spout 103, or between the contact ring 8 and the upper end of the side wall 11 of the spout 103. Also, in this case, the second region 10 of the inner ring 7 pushes the inner peripheral surface of the side wall 11 of the spout 103 outward, with which the second region 10 of the inner ring 7 is in contact.

Figure 9D:
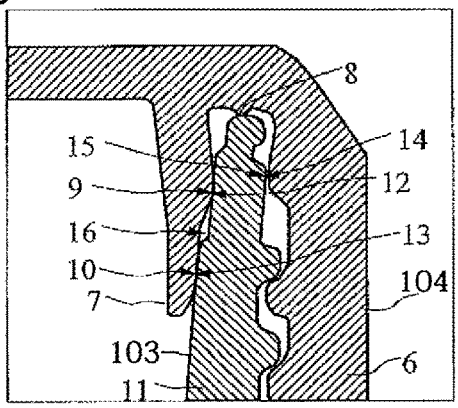
Figure 9D:
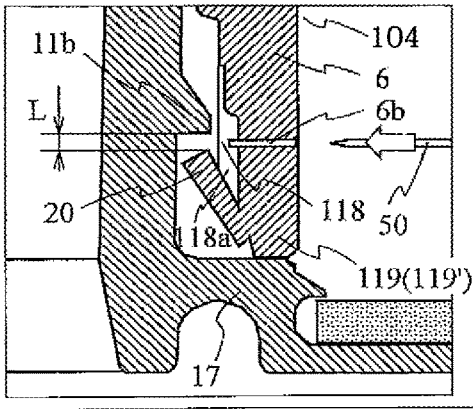

After that, the cap 104 is further rotated in the closing direction and the lower end of the band part forming portion 119' is permitted to abut against the flange 17 for close contact therewith. Then, as shown in FIG. 9D, at the lower end of the side wall 6 of the cap 104, the flap 20 clears the protrusion 11*b* in a state of being bent at an end portion continuously connected to the band part forming portion 119'. As a result, the cap 104 is brought into a state of being assembled to the spout 103. Thus, the flap 20 is held in the gap between the protrusion 11*b* and the flange 17 in a state of being bent at an end portion continuously connected to the band part 119, with the other end thereof being oriented to the top plate 5. It should be noted that FIG. 9D is the same as FIG. 7.

When the lower end of the band part forming portion 119' is permitted to abut against the flange 17 for close contact therewith, the center portion of the side wall 6 of the cap 104 in the height direction is instantaneously slightly bent inward. With this slight bending, the flap 20 inclines inward, i.e., inclines toward the gap between the protrusion 11*b* and the flange 17. Thus, the end of the flap 20 that has cleared the protrusion 11*b* is promptly held in the gap between the protrusion 11*b* and the flange 17. Accordingly, the flap 20 is prevented from being caught on the protrusion 11*b* and from not being held in the gap between the protrusion 11*b* and the flange 17.

Furthermore, the first region 9 of the inner ring 7 is brought into a state of closely contacting the first region 12 of the side wall 6 of the spout 103 throughout the circumference, the second region 10 of the inner ring 7 is brought into a state of closely contacting the second region 13 of the side wall 11 of the spout 103 throughout the circumference, the predetermined part 14 of the inner peripheral surface of the side wall 6 of the cap 104 is brought into a state of closely contacting the predetermined part 15 of the outer peripheral surface of the side wall 11 of the spout 103 throughout the circumference, and the contact ring 8 is brought into a state of closely contacting the upper end of the side wall 11 of the spout 103.

Then, a thin part 118 is formed in a state in which the lower end of the band part forming portion 119' of the cap 104 is in close contact with the flange 17. Specifically, as shown in FIG. 9D, a plate-shaped score cutter 50 is externally abutted against the side wall 6 of the cap 104, which is in close contact with the flange 17, so as to be perpendicular to the height direction of the cap 104. Thus, a groove 6*b* is formed throughout the circumference with a predetermined depth from the outer peripheral surface of side wall 6. The depth of the groove 6*b* (i.e., the thickness of the rib 118*a* in the radial direction) can be controlled according to the force of breaking the thin part 118 in the process of opening the spout assembly described later.

In this case, since the lower end of the band part forming portion 119' is in close contact with the flange 17, the cap 104 is prevented from moving or being deformed by the pressing force of the score cutter 50 abutted against the side wall 6. Thus, the groove 6*b* can be formed with stable depth and shape.

In a state in which the cap 104 has been assembled to the spout 103, a distance L between the end of the flap 20 and the protrusion 11*b* in the height direction of the cap 104 (see the diagram on the right of FIG. 9D) is preferred to be in the range of 0.1 mm or more and 0.3 mm or less. When the distance L is set to 0.1 mm or more, the flap 20 that has cleared the protrusion 11*b* is prevented from being caught on the protrusion 11*b* and thus from not being held in the gap between the protrusion 11*b* and the flange 17. When the distance L is set to 0.3 mm or less, if the cap 104 is loosened due to vibration or the like and rotated in the opening direction, the end of the flap 20 can be promptly brought into abutment against the protrusion 11*b* as long as the thin part 118 is not broken. Therefore, the amount of upward movement of the cap 104 can be minimized and adhesion between the inner ring 7 and the side wall 6 of the spout 103 can be maintained. Desirably, if the threadable engagement is loosened from the state in which the cap 104 is assembled to the spout 103, and the cap 104 is rotated in the opening direction and the end of the flap 20 is brought into contact with the protrusion 11*b*, it is preferred that, as long as the thin part 118 is not broken, contacts are achieved between the first region 9 of the inner ring 7 and the first region 12 of the side wall 11 of the spout 103 and between the second region 10 of the inner ring 7 and the second region 13 of the side wall 11 of the spout 103 to maintain good sealing properties.

In the spout assembly 101, the force of lessening or even preventing loosening of the threadable engagement and maintaining sealing properties (friction between the band part 119 and the flange 17) can be controlled by adjusting the tightening torque applied in the process of assembling the cap.

(Opening Process)

When opening the closed spout assembly 101, first, the assembled cap 104 is rotated in the opening direction. With the rotation, the cap 104 is moved upward relative to the spout 103. When the cap 104 is moved upward by the distance L, the end of the flap 20 is brought into abutment against the protrusion 11*b* to restrain the upward movement of the band part 119.

When the cap 104 is further rotated in the opening direction and moved upward, the thin part 118 between the band part 119 whose movement has been restrained and the side wall 6 of the cap 104 is pulled in the vertical direction and broken. As a result, the band part 119 is separated from the lower end of the side wall 6. With the band part 119 separated, when the cap 104 is further rotated in the opening direction and disassembled from the spout 103, the spout assembly 101 can be opened.

The magnitude of the force (torque) applied to the cap 104 at the time of opening the spout assembly by breaking the thin part 118 depends on the thickness of the thin part 118 in the radial direction. Accordingly, the force (torque) can be controlled by adjusting the thickness of the groove 6*b* formed by the score cutter 50. The magnitude of the force in this case is preferred to be a strength not breaking the thin part 118 with the tightening torque applied during the cap assembling process.

The spout assembly 101 ensures good sealing properties by lessening or even preventing loosening using friction between the band part 119 and the flange 17. Accordingly, torque overcoming the friction is required to be instantaneously applied only when starting opening, but no larger force is required in the rotation thereafter. Thus, force required for opening is prevented from increasing.

Third Embodiment (Spout Assembly)

Figure 10:
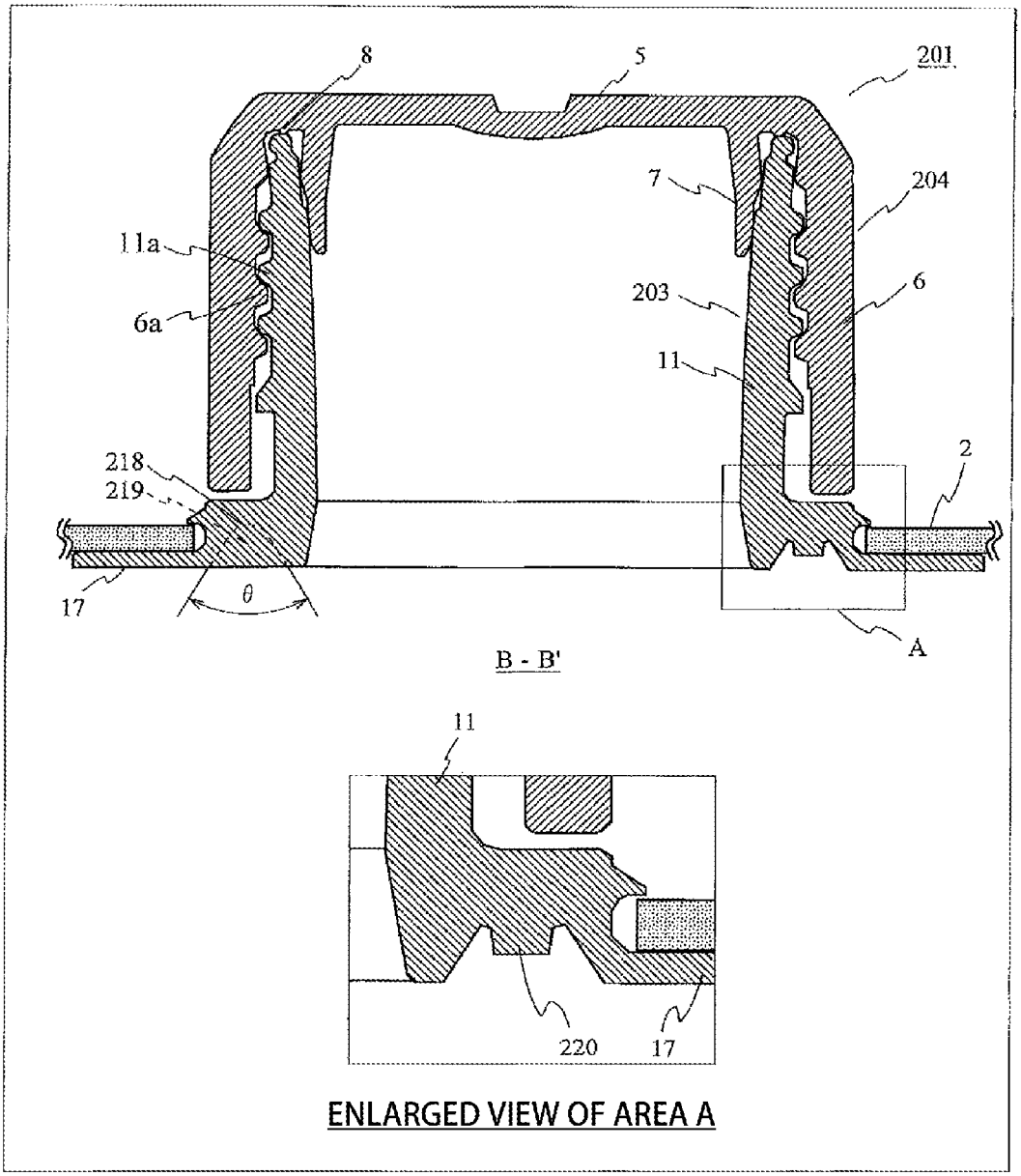
FIG. 10 is a set of diagrams each illustrating a cross section of a spout assembly according to a third embodiment.
Figure 11:
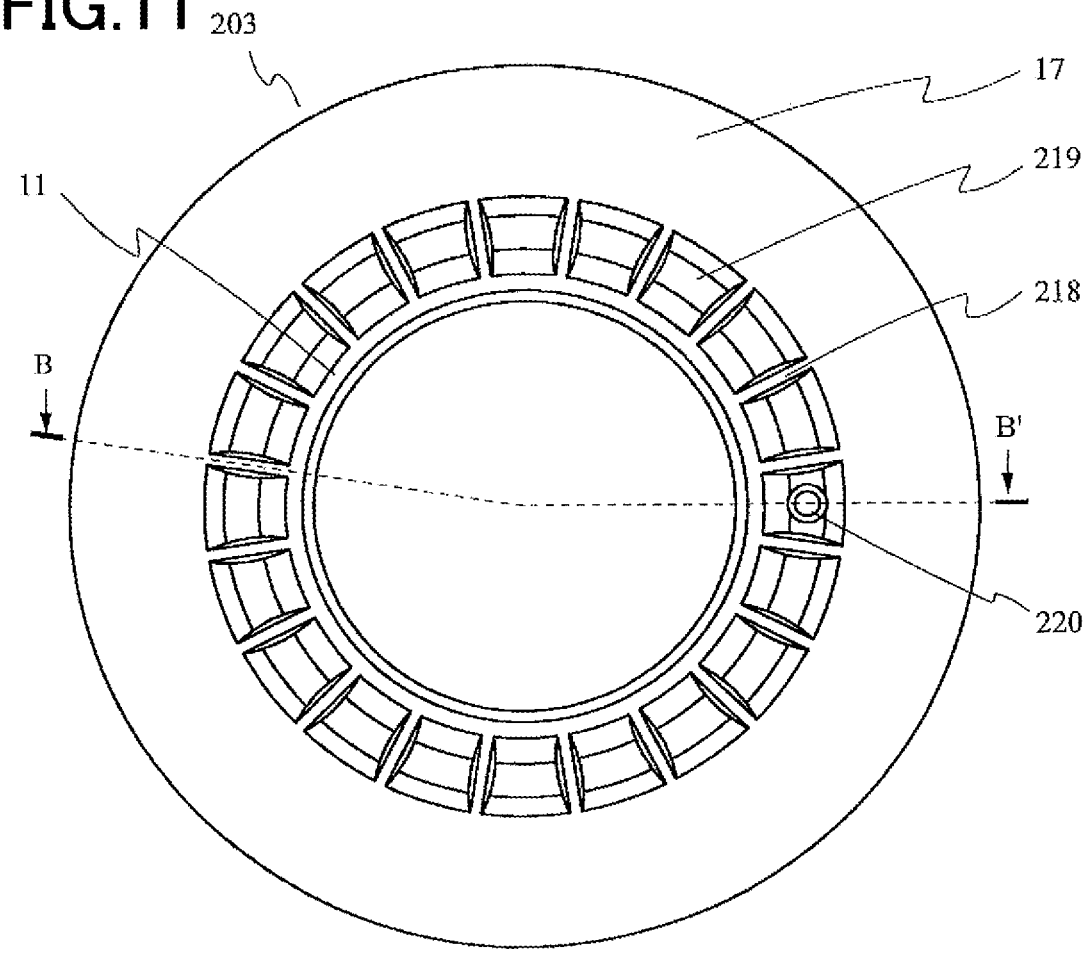
FIG. 11 is a bottom view illustrating a spout according to the third embodiment.
Figure 12:
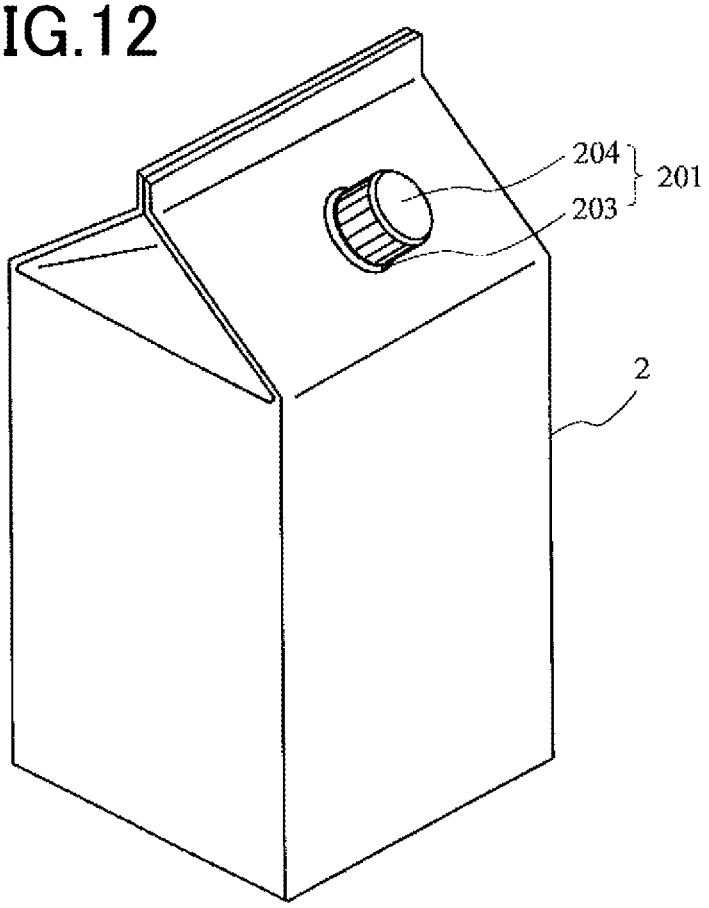
FIG. 12 is a perspective view illustrating a packaging container provided with the spout assembly according to the third embodiment.

A third embodiment of the present invention will be described. FIG. 10 is a set of diagrams each illustrating a cross section of a spout assembly according to the third embodiment. FIG. 11 is a bottom view illustrating a spout. FIG. 12 is a perspective view illustrating a packaging container provided with the spout assembly according to the third embodiment. It should be noted that FIG. 10 are cross sections taken along the line B-B' of FIG. 11.

As shown in FIGS. 10 and 12, a spout assembly 201 includes a spout 203 that is mounted to a container body 2 by ultrasonic welding, and a cap 204 that is assembled to the spout 203 and capable of hermetically closing the spout 203. As an example, the cap 204 can be threadably engaged with the spout 203.

(Cap)

As an example, the cap 204 includes a top plate 5, a side wall 6, an inner ring 7 and a contact ring 8. The side wall 6 is connected to the outer peripheral edge of the top plate 5 and has an inner peripheral surface on which internal threads 6*a* are formed. The inner ring 7 has a cylindrical shape and is circumferentially provided to the top plate 5. The contact ring 8 is provided between the side wall 6 of the top plate 5 and the inner ring 7.

(Spout)

The spout 203 includes a side wall 11 having a cylindrical shape and a flange 17 extending outward from an end edge of the side wall 11. The side wall 11 has an outer peripheral surface on which, as an example, external threads 11*a* are formed. The spout 203 can be produced by injection molding using a resin material described later. The flange 17 serves as a joint when the spout 203 is mounted to the container body 2.

As shown in FIGS. 10 and 11, the flange 17 has a surface facing away from the side wall 11, on which a plurality of recesses 219 are formed. These recesses 219 are arranged concentrically with the side wall 11 in plan view, being defined by ribs 218. As shown in FIG. 10, for example, each recess 219 may have a cross section having a dome-shaped top surface and spreading toward a surface of the flange 17 facing away from the side wall 11. The spreading surface may have a spreading angle θ (see FIG. 10) in the range of 50° or more and 70° or less. With this angle, vibration during ultrasonic welding described later can be suitably absorbed.

From one of the recesses 219, a gate entrance 220 is protruded. The gate entrance 220 protrudes in the axial direction of the side wall 11 to a position not beyond the surface of the flange 17 facing away from the side wall 11. As an example, the gate entrance 220 is formed into a cylindrical shape. The gate entrance 220 refers to the gate of the cavity into which the flow of a molten resin material is directed at the time of injection molding.

As an example, the spout 203 and the container body 2 can be welded to each other by placing an ultrasonic horn (not shown) on the container body 2 where an anvil (not shown) as a receiver inserted into the container body 2 overlaps with the flange 17 of the spout 203, and generating ultrasonic vibration. The vibration generated then is transferred from the flange 17 to the side wall 11, however, part of the vibration is absorbed by the recesses 219 and the ribs 218. Therefore, parts of the spout 203 are prevented from being deformed by the vibration.

The die used for injection-molding the spout 203 is provided with a gate at a position corresponding to a recess 219 so that the gate entrance 220 can be formed protruding from the recess 219. Also, flow of a resin material directed to the cavity via the gate can be simultaneously filled in portions of the cavity corresponding to the side wall 11 and the flange 17. Thus, the resin material can be uniformly filled in the cavity and therefore the occurrence of residual stresses or deformation, such as sink marks or warpage, can be reduced or prevented. Consequently, the occurrence of cracking due to ultrasonic welding can be reduced or prevented.

By providing the gate in the axial direction of the side wall 11, the gate entrance 220 can be formed protruding in the axial direction of the side wall 11. Moreover, the flow of the resin material passing through the gate can be linearly directed in the axial direction of the side wall 11. Thus, the flow of the resin material in the cavity can be stabilized even more and therefore the occurrence of residual stresses or deformation, such as sink marks or warpage, can be reduced or prevented.

By permitting the gate entrance 220 to protrude from the recess 219, the end of the gate entrance 220 in which the resin material is unlikely to be uniformly filled can be formed at a position away from the flange 17 that forms a vibration propagation path. Thus, in the occurrence of residual stresses at the end of the gate entrance 220, the influence of the force can be reduced and the occurrence of cracking can be reduced or prevented.

Since the occurrence of cracking due to ultrasonic welding can be reduced or prevented, the spout 203 enables welding with higher energy than usual. Consequently, weld strength can be increased or the time required for welding can be shortened.

Although detailed explanation is omitted, as in the spout assembly 1, the inner ring 7 of the cap 204 and the side wall 11 of the spout 203 are formed such that the outer peripheral surface of the inner ring 7 is brought into close contact with the inner peripheral surface of the side wall 11, in a state in which the cap 204 has been assembled to the spout 203. The close contact between the outer peripheral surface of the inner ring 7 and the inner peripheral surface of the spout 203 can ensure good sealing properties with a structure in which the spout 203 has no closure plate.

For example, the material for the spout 203 may be low density polyethylene or straight-chain low density polyethylene. The material for the cap 204 may be, for example, polypropylene. However, materials for the spout 203 and the cap 204 are not limited to these materials. To enhance adhesion strength between the spout 203 and the cap 204, the spout 203 may be formed using a material whose rigidity is lower than that of the material for the cap 204. When the spout 203 is made of a material whose rigidity (flexural modulus) is smaller than the rigidity of the material for the cap 204, it is preferred that the material for the spout 203 has a flexural modulus in the range of 100 MPa or more and 1,200 MPa or less and the material for the cap 204 has a flexural modulus in the range of 1,000 MPa or more and 2,100 MPa or less.

The embodiments described above have features that they can be suitably combined. For example, the ribs 218, the recesses 219 and the gate entrance 220 of the spout 203 may be formed in the spout 103 of the spout assembly 101.

INDUSTRIAL APPLICABILITY

The spout assembly and the packaging container having the spout assembly according to the present invention can be suitably applied, for example, to spout assemblies provided to packaging containers holding contents, such as liquid, or to packaging containers having spout assemblies.

REFERENCE SIGNS LIST

1, 101, 201 Spout assembly; 2 Container body; 3, 103, 203; Spout 4, 104, 204; Cap; 5 Top plate; 6 Side wall; 6*a* Internal thread; 6*b* Groove; 7 Inner ring; 8 Contact ring; 9 First region; 10 Second region; 11 Side wall; 11*a* External thread; 11*b* Protrusion; 12 First region; 13 Second region; 14 Predetermined part; 15 Predetermined part; 16 Space; 17 Flange; 18 Protrusion; 19 Groove; 118 Thin part; 118*a* Rib; 119 Band part; 119*a* Communication part; 20 Flap; 50 Score cutter; 218 Rib; 219 Recess; 220 Gate entrance

What is claimed is:

1. A spout assembly comprising a spout welded to a container body, and a cap threadably engaged with the spout, wherein the cap includes a top plate, a side wall connected to an outer peripheral edge of the top plate and having an inner peripheral surface on which internal threads are formed, and an inner ring circumferentially provided to an inner surface of the top plate;

the inner ring has an outer peripheral surface including, sequentially from the top plate, a first region having a first outer diameter, and a second region having a second outer diameter whose outermost diameter is smaller than the first outer diameter;

the spout includes a side wall having an outer peripheral surface on which external threads are formed, the spout being made of a material having rigidity that is lower than that of the material for the cap;

the side wall of the spout has an inner peripheral surface including, sequentially from an upper end facing away from the container body, a first region having a first inner diameter, and a second region having a second inner diameter whose innermost diameter is smaller than the first inner diameter; and in a state in which the cap is threadably engaged with the spout, the first region of the inner ring is in close contact with the first region of the side wall of the spout throughout the circumference, the second region of the inner ring is in close contact with second region of the side wall of the spout throughout the circumference, a predetermined part of the inner peripheral surface of the side wall of the cap is in close contact with a predetermined part of the outer peripheral surface of the side wall of the spout, and a space is formed between an area in which the first region of the inner ring is in close contact with the first region of the side wall of the spout and an area in which the second region of the inner ring is in close contact with the second region of the side wall of the spout, and wherein in a state in which the cap has been disassembled from the spout, a difference between the first outer diameter of the inner ring and the first inner diameter of the side wall of the spout is larger than a difference between the second outer diameter of the inner ring and the second inner diameter of the side wall of the spout.

2. The spout assembly of claim 1, wherein the cap further includes a contact ring that is formed on the top plate and positioned between the side wall of the cap and the inner ring; and the contact ring is in close contact with an upper end of the side wall of the spout in a state in which the cap is threadably engaged with the spout.

3. The spout assembly of claim 2, wherein in a process of placing the cap on the spout and rotating the cap in a closing direction, the first region of the inner ring pushes the side wall of the spout outward to closely contact the inner peripheral surface of the side wall of the spout;

the second region of the inner ring thereafter pushes the side wall of the spout outward even more to contact the inner peripheral surface of the side wall of the spout; and the cap is thereafter brought into a state of being threadably engaged with the spout.

4. The spout assembly of claim 1, wherein, in a state in which the cap has been disassembled from the spout, a difference between the first outer diameter of the inner ring and the first inner diameter of the side wall of the spout is 0.30 mm or more and 0.50 mm or less;

a difference between the second outer diameter of the inner ring and the second inner diameter of the side wall of the spout is 0.10 mm or more and 0.30 mm or less; and a difference between an inner diameter of the predetermined part of the inner peripheral surface of the side wall of the cap and an outer diameter of the predetermined part of the outer peripheral surface of the side wall of the spout is 0.20 mm.

5. The spout assembly of claim 1, wherein a thickness of the inner ring in the first region is larger than a thickness of the side wall of the spout in the first region; and a thickness of the inner ring in the second region is smaller than a thickness of the side wall of the spout in the second region.

6. The spout assembly of claim 1, wherein the cap further includes a band part and one or more flaps, the band part having a cylindrical shape and being mounted to the cap via a first part that is provided to an end of the side wall of the cap, the end of the side wall facing away from the top plate, each of the one or more flaps having a first end continuously connected to an end of the band part, the end of the band part facing away from the first part;

the spout further includes a flange and a protrusion, the flange extending outward from an end edge of the side wall of the spout, the protrusion extending outward from an area between an external thread on the outer peripheral surface of the side wall of the spout and the flange; and in a state in which the cap is threadably engaged with the spout, the end of the band part facing away from the first part is in close contact with the flange, and each of the one or more flaps is held in a gap between the protrusion and the flange, the flap being in a state of being bent at the first end continuously connected to the band part, with a second end of the flap being inclined and oriented toward the top plate.

7. The spout assembly of claim 6, wherein, in a state in which the threadable engagement between the cap and the spout is loosened and the second end of the flap is in contact with the protrusion, the first region of the inner ring is in close contact with the first region of the side wall of the spout throughout the circumference;

the second region of the inner ring is in close contact with the second region of the side wall of the spout throughout the circumference;

a predetermined part of the inner peripheral surface of the side wall of the cap is in close contact with a predetermined part of the outer peripheral surface of the side wall of the spout throughout the circumference; and a space is formed between an area in which the first region of the inner ring is in close contact with the first region of the side wall of the spout and an area in which the second region of the inner ring is in close contact with the second region of the side wall of the spout.

8. The spout assembly of claim 6, wherein the end of the band part facing away from the first part includes one or more communication parts establishing communication between interior and exterior of the cap.

9. The spout assembly of claim 6, wherein, in a state in which the cap is threadably engaged with the spout, a distance between the second end of the flap and the protrusion in a height direction of the cap is 0.1 mm or more and 0.3 mm or less.

10. The spout assembly of claim 1, wherein the spout further includes:

a flange extending outward from an end edge of the side wall of the spout;

a plurality of recesses arranged on a surface of the flange facing away from the side wall of the spout, the recesses being arranged concentrically with the side wall of the spout in plan view and defined by ribs; and a gate entrance protruding in the axial direction of the side wall of the spout from one of the recesses to a position not beyond the surface of the flange facing away from the side wall of the spout.

11. A packaging container provided with the spout assembly of claim 1.

12. A spout assembly comprising a spout welded to a container body, and a cap threadably engaged with the spout, wherein the cap includes a top plate, a side wall connected to an outer peripheral edge of the top plate and having an inner peripheral surface on which internal threads are formed, and an inner ring circumferentially provided to an inner surface of the top plate;

the inner ring has an outer peripheral surface including, sequentially from the top plate, a first region having a first outer diameter, and a second region having a second outer diameter whose outermost diameter is smaller than the first outer diameter;

the spout includes a side wall having an outer peripheral surface on which external threads are formed, the spout being made of a material having rigidity that is lower than that of the material for the cap;

the side wall of the spout has an inner peripheral surface including, sequentially from an upper end facing away from the container body, a first region having a first inner diameter, and a second region having a second inner diameter whose innermost diameter is smaller than the first inner diameter; and in a state in which the cap is threadably engaged with the spout, the first region of the inner ring is in close contact with the first region of the side wall of the spout throughout the circumference, the second region of the inner ring is in close contact with second region of the side wall of the spout throughout the circumference, a predetermined part of the inner peripheral surface of the side wall of the cap is in close contact with a predetermined part of the outer peripheral surface of the side wall of the spout, and a space is formed between an area in which the first region of the inner ring is in close contact with the first region of the side wall of the spout and an area in which the second region of the inner ring is in close contact with the second region of the side wall of the spout, and wherein the spout further includes:

a flange extending outward from an end edge of the side wall of the spout;

a plurality of recesses arranged on a surface of the flange facing away from the side wall of the spout, the recesses being arranged concentrically with the side wall of the spout in plan view and defined by ribs; and a gate entrance protruding in the axial direction of the side wall of the spout from one of the recesses to a position not beyond the surface of the flange facing away from the side wall of the spout.

13. The spout assembly of claim 12, wherein the cap further includes a contact ring that is formed on the top plate and positioned between the side wall of the cap and the inner ring; and the contact ring is in close contact with an upper end of the side wall of the spout in a state in which the cap is threadably engaged with the spout.

14. The spout assembly of claim 13, wherein, in a process of placing the cap on the spout and rotating the cap in a closing direction, the first region of the inner ring pushes the side wall of the spout outward to closely contact the inner peripheral surface of the side wall of the spout;

the second region of the inner ring thereafter pushes the side wall of the spout outward even more to contact the inner peripheral surface of the side wall of the spout; and the cap is thereafter brought into a state of being threadably engaged with the spout.

15. The spout assembly of claim 12, wherein a thickness of the inner ring in the first region is larger than a thickness of the side wall of the spout in the first region; and a thickness of the inner ring in the second region is smaller than a thickness of the side wall of the spout in the second region.

16. The spout assembly of claim 12, wherein the cap further includes a band part and one or more flaps, the band part having a cylindrical shape and being mounted to the cap via a first part that is provided to an end of the side wall of the cap, the end of the side wall facing away from the top plate, each of the one or more flaps having a first end continuously connected to an end of the band part, the end of the band part facing away from the first part;

the spout further includes a flange and a protrusion, the flange extending outward from an end edge of the side wall of the spout, the protrusion extending outward from an area between an external thread on the outer peripheral surface of the side wall of the spout and the flange; and in a state in which the cap is threadably engaged with the spout, the end of the band part facing away from the first part is in close contact with the flange, and each of the one or more flaps is held in a gap between the protrusion and the flange, the flap being in a state of being bent at the first end continuously connected to the band part, with a second end of the flap being inclined and oriented toward the top plate.

17. The spout assembly of claim 16, wherein, in a state in which the threadable engagement between the cap and the spout is loosened and the second end of the flap is in contact with the protrusion, the first region of the inner ring is in close contact with the first region of the side wall of the spout throughout the circumference;

the second region of the inner ring is in close contact with the second region of the side wall of the spout throughout the circumference;

a predetermined part of the inner peripheral surface of the side wall of the cap is in close contact with a predetermined part of the outer peripheral surface of the side wall of the spout throughout the circumference; and a space is formed between an area in which the first region of the inner ring is in close contact with the first region of the side wall of the spout and an area in which the second region of the inner ring is in close contact with the second region of the side wall of the spout.

18. The spout assembly of claim 16, wherein the end of the band part facing away from the first part includes one or more communication parts establishing communication between interior and exterior of the cap.

19. The spout assembly of claim 16, wherein, in a state in which the cap is threadably engaged with the spout, a distance between the second end of the flap and the protrusion in a height direction of the cap is 0.1 mm or more and 0.3 mm or less.

20. A packaging container provided with the spout assembly of claim 12.

* * * * *